US012454794B2

(12) United States Patent
Eberhardt

(10) Patent No.: US 12,454,794 B2
(45) Date of Patent: Oct. 28, 2025

(54) PRESS FELT

(71) Applicant: VOITH PATENT GMBH, Heidenheim (DE)

(72) Inventor: Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 325 days.

(21) Appl. No.: 18/042,316

(22) PCT Filed: Jun. 30, 2021

(86) PCT No.: PCT/EP2021/067968
§ 371 (c)(1),
(2) Date: Feb. 21, 2023

(87) PCT Pub. No.: WO2022/037832
PCT Pub. Date: Feb. 24, 2022

(65) Prior Publication Data

US 2024/0026607 A1 Jan. 25, 2024

(30) Foreign Application Priority Data

Aug. 18, 2020 (DE) ..... 10 2020 121 627.0

(51) Int. Cl.
*D21F 7/08* (2006.01)

(52) U.S. Cl.
CPC ..... *D21F 7/083* (2013.01)

(58) Field of Classification Search
CPC ..... D21F 7/083; D21F 1/0036; D21F 1/00
See application file for complete search history.

(56) References Cited

U.S. PATENT DOCUMENTS

| | | | | |
|---|---|---|---|---|
| 4,259,394 | A | 3/1981 | Khan | |
| 5,549,967 | A | 8/1996 | Gstrein | |
| 5,888,915 | A | 3/1999 | Denton et al. | |
| 6,872,283 | B2 | 3/2005 | Best | |
| 6,902,652 | B2 | 6/2005 | Martin | |
| 9,714,483 | B2 | 7/2017 | Straub et al. | |
| 2010/0108282 | A1 | 5/2010 | Ewalds et al. | |
| 2011/0294386 | A1* | 12/2011 | Kockritz | D21F 7/083 162/199 |
| 2013/0333792 | A1 | 12/2013 | Eberhardt et al. | |

(Continued)

FOREIGN PATENT DOCUMENTS

| | | | |
|---|---|---|---|
| CN | 1784522 | A | 6/2006 |
| CN | 102325939 | A | 1/2012 |
| CN | 103392037 | A | 11/2013 |

(Continued)

*Primary Examiner* — Abbas Rashid
*Assistant Examiner* — Matthew M Eslami
(74) *Attorney, Agent, or Firm* — Laurence A. Greenberg; Werner H. Stemer; Ralph E. Locher

(57) ABSTRACT

A press felt for a machine for producing a fibrous material web has a woven base structure and a nonwoven support fixed thereon. The base structure includes a first fabric layer and a second fabric layer, wherein at least the first fabric layer has longitudinal threads and transverse threads which intersect at intersecting points. The longitudinal threads and the transverse threads of the first fabric layer are integrally bonded to each other, in particular welded to each other, at at least 5% of the intersecting points, in particular at at least 10% of the intersecting points.

17 Claims, 2 Drawing Sheets

(56) References Cited

U.S. PATENT DOCUMENTS

2019/0112763 A1* 4/2019 Eberhardt ..... D21F 11/14

FOREIGN PATENT DOCUMENTS

| | | | | |
|---|---|---|---|---|
| DE | 4404507 | A1 | 8/1995 | |
| DE | 69616413 | T2 | 6/2002 | |
| DE | 69730052 | T2 | 12/2004 | |
| DE | 102007028365 | A1 | 12/2008 | |
| DE | 102012207016 | A1 | 10/2013 | |
| DE | 202019102306 | U1 | 9/2019 | |
| EP | 0425523 | B1 | 3/1995 | |
| EP | 0672784 | B1 | 9/2000 | |
| EP | 1357223 | A1 | 10/2003 | |
| EP | 2160495 | B1 | 12/2015 | |
| EP | 2678472 | B1 | 3/2016 | |
| EP | 3730693 | A1 * | 10/2020 | ..... D21F 7/083 |
| WO | 2006020097 | A1 | 2/2006 | |
| WO | 2009032271 | A2 | 3/2009 | |

* cited by examiner

PRESS FELT

FIELD AND BACKGROUND OF THE INVENTION

The invention relates to a press felt in accordance with the preamble of the independent claim.

In the production of paper or cardboard, coverings in the form of press felts are used for transporting and dewatering the fibrous material web in the region of the press section. The main components of such felts are a load-bearing base structure and nonwoven plies, which are generally needled to the base structure. In most cases, woven fabrics are used for the base structures.

To increase the volume for liquid absorption and also to increase strength, the load-bearing base structure can have a plurality of fabric plies which are arranged one above the other. Felts with such base structures are described in EP 0 425 523 or EP 0 672 784 B1, for example. It is likewise also possible, as described in EP2160495 B1, to provide several plies of nonwoven fibers having different fiber counts.

During operation, a press felt is subjected to repeated loads in one or more press nips. In the press nip, the felt is compressed, and, after passage through the press nip, the felt expands again substantially to its original thickness. Since this process is carried out extremely frequently, compaction of the felt occurs after only a short time. According to the prior art, the explanation for this is compression of the nonwoven plies. Compaction of the fabric plies with the formation of a layer of reduced permeability also occurs. This changes important properties of the felt, such as, for example, permeability. In order to compensate for this, it is known, e.g. from EP 2 678 472, to provide a particularly fine nonwoven ply which is abraded during operation of the felt. As a result of the abrasion of the fine nonwoven fibers, the permeability of the felt is increased while the permeability is simultaneously being reduced by compaction. Although a largely constant permeability of the felt can thereby be achieved, the provision of the "sacrificial nonwoven ply" is associated with additional costs and effort.

SUMMARY OF THE INVENTION

It is therefore an object of the invention to propose a press felt in which the tendency for compaction is reduced. It is furthermore an object of the present invention to propose a felt which provides a large volume for liquid absorption.

According to the invention, the object is achieved by means of an embodiment as claimed in the independent claim. Further advantageous embodiments of the present invention can be found in the dependent claims.

Here, the proposal is for a press felt for a machine for producing a fibrous material web, comprising a woven base structure and a nonwoven overlay fixed thereon, wherein the base structure comprises a first fabric ply and a second fabric ply. According to the invention, it is envisaged that at least the first fabric ply has longitudinal threads and transverse threads which intersect at intersections, wherein the longitudinal threads and the transverse threads of the first fabric ply are welded to one another at at least 5% of the intersections, in particular at at least 10% of the intersections.

In this context, the terms "longitudinal threads" and "MD threads" as well as "transverse threads" and "CD threads" are synonyms.

As mentioned, base structures which have a plurality of fabric plies are advantageous as regards the provision of a large volume for liquid absorption ("void volume"). However, it has been found that such felts also have a relatively high tendency for compaction. The inventor has recognized that some of this compaction effect is due to the fact that the various fabric plies are partially pressed into one another by the loads in the nip. This is promoted or reinforced by the fact that the threads of the fabrics can be displaced to a certain extent. Continued loading in the nip can result in displacement of the individual MD or CD threads in such a way that threads of one ply are pressed into interspaces of the other ply, thereby increasing compaction of the felt and also reducing permeability.

In order to prevent this effect, or at least to significantly reduce it, it is proposed by the inventor that, at least in the first fabric ply, parts of the longitudinal threads and transverse threads that intersect at intersections are welded to one another. It has proven to be advantageous here if the longitudinal threads and the transverse threads of the first fabric ply are connected to one another in an integrally bonded manner, in particular welded to one another, at at least 5% of the intersections, in particular at at least 10% of the intersections. In this way, the displacement of the threads is prevented or made more difficult, and the above-described compacting effect is suppressed.

With an increase in the proportion of the welded intersections, e.g. to 15%, 20%, 25%, 30%, 35%, 40% or more, the fixing of the threads and the suppression of displaceability increases. However, this also increases the stiffness of the base structure and thus of the felt as a whole. This is usually only possible or desired up to a certain extent. Thus, it is often advantageous if the longitudinal threads and the transverse threads of the first fabric ply are welded to one another at less than 60%, in particular at less than 50%, of the points of intersection.

The advantageous effect of the invention can be increased if the second fabric ply also has longitudinal threads and transverse threads which intersect at intersections, wherein the longitudinal threads and the transverse threads of the second fabric ply are connected to one another in an integrally bonded manner, in particular welded to one another, at at least 5% of the intersections, in particular at at at least 10% of the intersections. This reduces the mobility of the threads of the two plies relative to one another even further. In the second ply too, it is the case that, with an increase in the proportion of the welded intersections, e.g. to 15%, 20%, 25%, 30%, 35%, 40% or more, the fixing of the threads and the suppression of displaceability increases and that it is often advantageous if the longitudinal threads and the transverse threads of the second fabric ply are welded to one another at less than 60%, in particular at less than 50%, of the points of intersection.

Even if, in most of the examples described, the base structure has exactly two fabric plies, it is also possible to provide embodiments in which the base structure also comprises one or more further plies, in particular one or more further fabric plies.

The integral bond at the points of intersection can be produced in various ways.

It is possible, for example, to use two-component fibers ("BiCo fibers"). Bi-component fibers consist of two components, e.g. a core and a sheath. Here, the two polymers have different softening or melting temperatures. The melting temperature of the core is higher than in the case of the sheath, and therefore the sheath can be melted when a certain temperature is applied and thus creates connection points between the respective core fibers in the mixture of the matrix present.

An alternative to this is to connect the MD and CD fibers to one another via welded joints. To create the welded joint, various methods are possible, such as ultrasonic welding or transmission welding. NIR transmission welding is regarded as particularly advantageous. This is because the threads of polyamide which are usually used are largely transparent to light from the NIR range between about 780 nm and 1100 nm.

It is then advantageous to make provision for at least some of the longitudinal threads and/or transverse threads of the first ply—and/or of the second ply—to absorb laser light of a wavelength which is in the range between 780 nm and 1100 nm completely or to a significant extent. (Absorption of more than 30%, in particular more than 40%, of the corresponding light is regarded as significant absorption in this context. Such threads are referred to below as absorbent threads). Given suitable irradiation of the fabric with light from this wavelength range, the light penetrates through the non-absorbent threads relatively unhindered and is absorbed by the absorbent threads. As a result, the contact point of the two threads heats up to such an extent that welding takes place.

As an advantageous possibility, the absorbent threads can consist of the same polymer as the other threads, to which an absorber additive is additionally admixed. In this way, particularly durable welded joints can be achieved. Alternatively, instead of the same polymer, it is also possible to use compatible polymers, e.g. polyamide 6 and polyamide 6.6.

Furthermore, it is also possible to use quasi-simultaneous welding methods in order to produce spot welds. In this case, it is possible to dispense in part with the use of absorbers.

By selective irradiation of selected contact regions/points of intersection, it is possible to weld only these. It is possible, for example, for this selective irradiation to take place in the form of regular patterns, e.g. in the form of straight lines, wavy lines, dot patterns, etc. The width of these lines or the diameter of the points can, in particular, be selected to be so large that a plurality of points of intersection, in particular 2, 3, 4, 5 or more, are covered by them.

It is advantageous for the desired effect if the points of intersection having the integral bonds are not situated exclusively in a partial region of the covering—in particular a seam region—but are distributed, in particular uniformly, over the entire area of the covering.

Such a uniform distribution can be achieved, for example, in that absorbent threads are woven in as CD threads or else as MD threads according to a fixed, predetermined pattern. Thus, for example, provision can be made for every tenth CD thread to be an absorbent thread. This leads to a rather small number of connection points. If every fourth CD thread, every second CD thread or even every CD thread is woven in as an absorbent thread, the number of possible connection points is increased.

Similarly, BiCo threads can also be woven in according to the pattern described above.

There are very wide degrees of freedom for the fabric plies described here. Some examples are listed below:

- The fabrics can be flat woven.
- The fabrics can be processed in a roll to roll process. In particular, a fabric with the integral bonds can be produced in rolls and then cut to size during the production of the actual felt.
- The fabrics can be flat woven and welded into a continuous band.
- The fabrics can be flat woven in continuous form.
- The fabrics can have a seam joint, preferably with a pintle seam.
- The fabrics can be single-ply or multi-ply.
- The fabrics can be woven from monofilaments and/or multifilaments and/or yarns.
- The fabrics can also be gauze fabrics.

In very advantageous embodiments, it can be provided that, for each intersection at which the longitudinal threads and the transverse threads are connected to one another in an integrally bonded manner in the first fabric ply and/or the second fabric ply, there is no integral bond at the adjacent intersections.

In this case, adjacent intersections are understood to mean the four intersections that are directly adjacent in the longitudinal and transverse directions.

Such an arrangement of the integral bonds, in particular of the welded joints, is advantageous since good fixing of the threads is possible here in this way, but the increase in the stiffness of the structure remains tolerable even with a comparatively high proportion of integrally bonded intersections (for example 30%, 40% or 50%).

Moreover, such a fabric ply is also simple to produce. Thus, for example, a fabric which is produced in plain weave can be used as the first fabric ply. For the fabric, it is possible to use longitudinal threads which are transparent to the light of a specific wavelength, while the transverse threads completely or partially absorb this wavelength. The integral bonds can then be implemented as welded joints by means of transmission welding with light of this wavelength.

If the fabric is irradiated from one side with light of this wavelength, e.g. with a laser, then there are points of intersection at which the transparent thread lies above the absorbent thread. At these points of intersection, the light penetrates through the transparent thread and is absorbed by the absorbent thread, as a result of which there is heating at the contact point and an integral bond is formed.

As a result of the plain weave, however, the absorbent thread now lies above the transparent thread at each of the four adjacent points of intersection. Therefore, the absorbent thread heats up only on its upper side, but not at the contact point. Thus, no integral bond is formed at these points of intersection.

If the entire fabric is irradiated with the laser using this method, then substantially 50% of the intersections are welded to one another.

However, it is also possible to irradiate only parts of the fabric with the laser. This results in a lower proportion of bonded intersections.

Further advantageous refinements of the invention are explained by means of exemplary embodiments with reference to the drawings. The features mentioned can be advantageously implemented not only in the combination shown but also individually in combination with one another. More specifically, the figures show:

DETAILED DESCRIPTION OF THE INVENTION

The figures are described in greater detail below.

Figure 1:
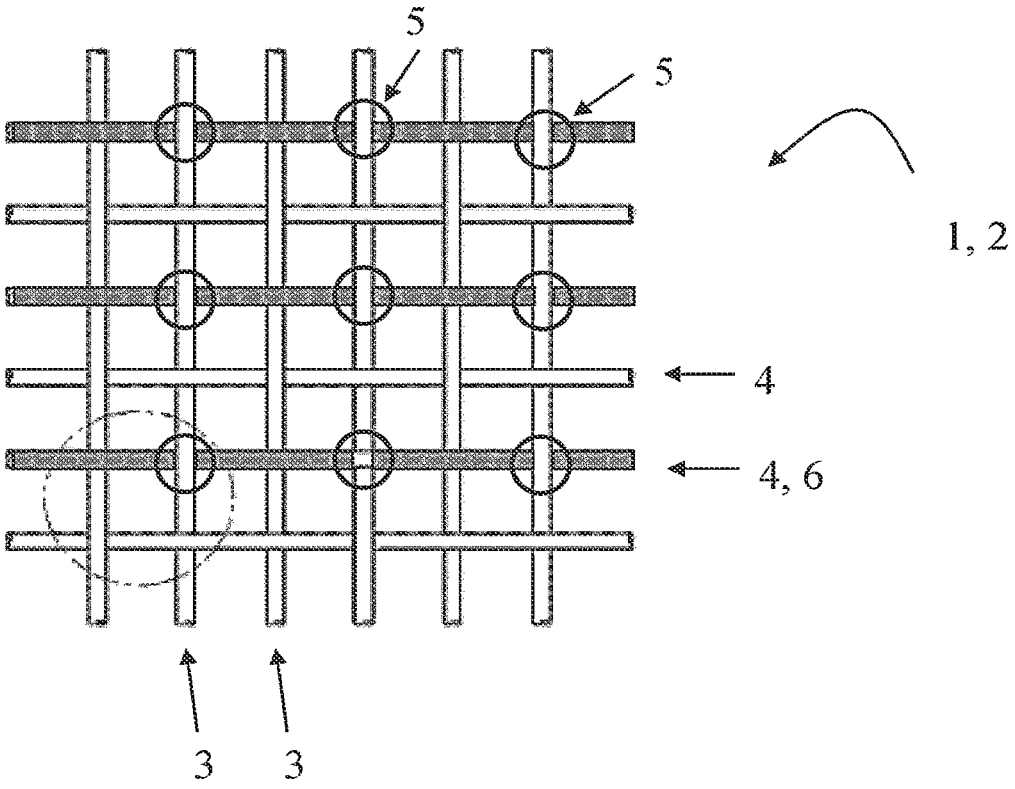
FIG. 1 fabric ply for a press felt according to one aspect of the invention

FIG. 1 shows a woven fabric ply, which can be used as the first woven fabric ply 1 or second woven fabric ply 2 in a press felt according to one aspect of the invention. It shows a fabric in plain weave comprising intersecting longitudinal threads 3 and transverse threads 4. In this case, some of the transverse threads 6 are embodied as absorbent threads 6. In the example shown in FIG. 1, every second transverse thread 4 is embodied as an absorbent thread 6. The other threads 3, 4 are made of a material, such as a polyamide, which is completely or largely transparent to light in the NIR range. The absorbent threads 6 can consist, for example, of the same polymer, to which an absorber additive is admixed. If the intersections 5 are irradiated with light from a wavelength range which the absorbent threads 6 absorb—for example by means of a corresponding NIR laser—this penetrates through the non-absorbent longitudinal threads 3 to the absorbent threads 6. These heat up primarily at the contact point of the two threads, resulting in the formation of an integral bond between the two threads in the form of a welded joint.

Here, either all of these intersections 5 can be welded, or else only some of them.

It should be noted here that, in the case of some of the intersections in FIG. 1, the absorbent thread 6 runs above the longitudinal thread 3. If the production of an integral bond is likewise desired at these intersections, it is advantageous to irradiate the fabric from the opposite side.

If irradiation is carried out only from one side, the fabric shown in FIG. 1 also results in an embodiment in which, for each intersection 5 at which the longitudinal threads 3 and the transverse threads 4 are connected to one another in an integrally bonded manner, there is no integral bond at the adjacent intersections 5.

In the case of such a fabric ply 1, 2, both the displacement of the longitudinal threads 3 in the transverse direction and the displacement of the transverse threads 4 in the longitudinal direction are impeded or prevented.

Figure 2A:
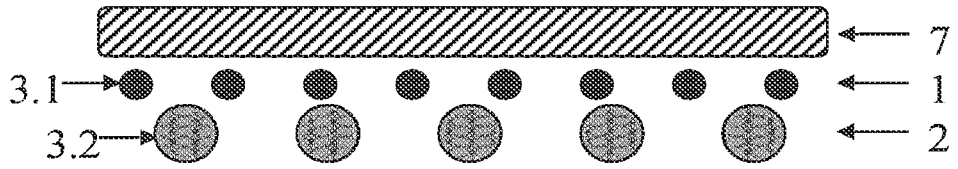
FIGS. 2*a*, 2*b* and 2*c* show the process of compacting, which is suppressed by an embodiment according to the present invention.
Figure 2B:
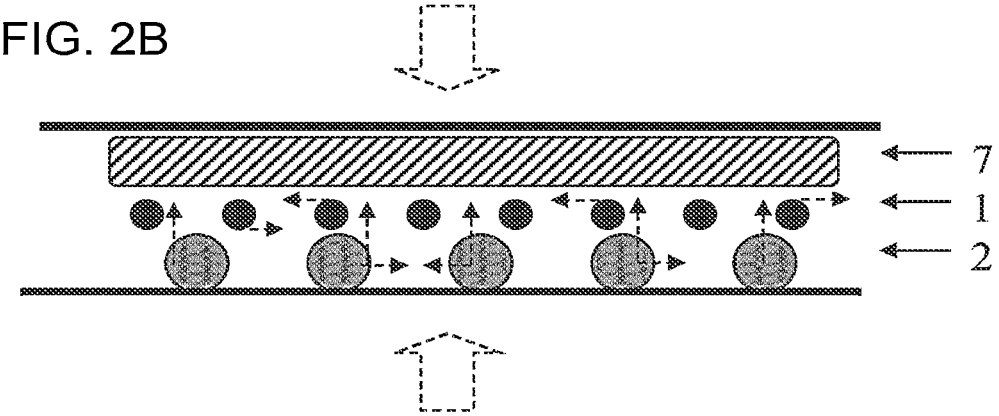
Figure 2C:
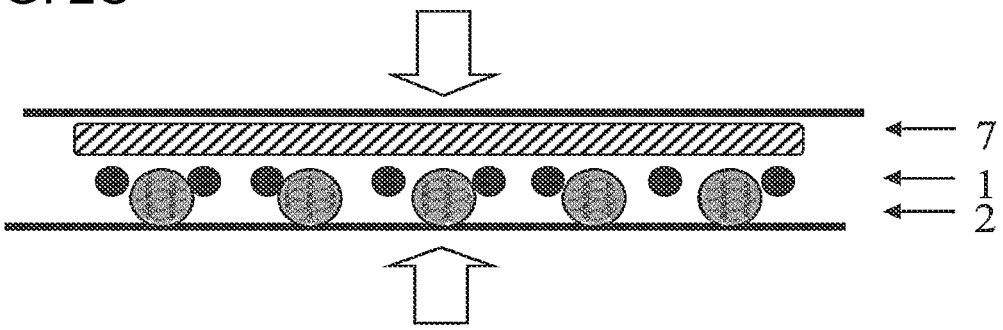

FIGS. 2*a*, 2*b* and 2*c* schematically show the behavior of a press felt under load, in which points of intersection 5 are not connected to one another in an integrally bonded manner in any of the fabric plies 1, 2. In this case, the press felt has a first fabric ply 1 and a second fabric ply 2, which together provide the base structure of the felt. A nonwoven overlay 7 is provided on the first fabric ply 1. For the sake of simplicity, only the longitudinal threads 3.1, 3.2 of the fabric plies 1, 2 are illustrated. In the felt illustrated here, the first fabric ply 1 and the second fabric ply 2 are different, this being illustrated here by way of example by different diameters of the longitudinal threads 3.1 of the first ply 1 and of the longitudinal threads 3.2 of the second ply 2. However, the two plies 1, 2 can also be of the same type of fabric, in particular they can be formed by folding a single piece of fabric and laying the folds one on top of the other, as described, for example, in EP 0 425 523.

Here, FIG. 2*a* shows the felt without an external load. As indicated in FIG. 2*b*, a load acts on the felt, e.g. as it passes through a press nip. The second fabric ply 2 is thereby pressed upward against the first fabric ply. This produces shear forces in the transverse direction on the longitudinal threads 3.1, 3.2, this being promoted by a round shape of the threads.

FIG. 2*c* then shows the felt in compressed form. On the one hand, the nonwoven overlay 7 is compressed by the external load. On the other hand, however, the longitudinal threads 3.1, 3.2 are also displaced in the transverse direction, with the result that the two fabric plies 1, 2 are partially pressed into one another. The "void volume" of one fabric ply 1, 2 is thus partially filled by the threads of the other fabric ply 2, 1 and is no longer available for liquid absorption.

Figure 3:
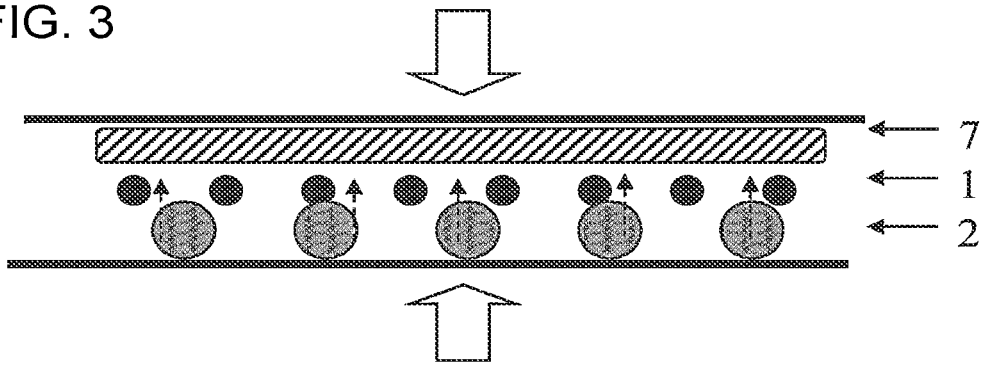
FIG. 3 shows a press felt according to one aspect of the invention

FIG. 3 differs from FIG. 2*c* only in that the felt is constructed according to one aspect of the present invention. That is to say that the longitudinal threads 3.1 and the transverse threads 4 of the first fabric ply 1 are connected to one another in an integrally bonded manner, in particular welded to one another, in particular at at least 5% of the intersections 5, in particular at at least 10% of the intersections 5. Provision can furthermore also be made for the longitudinal threads 3.2 and the transverse threads 4 of the second fabric ply 2 to be connected to one another in an integrally bonded manner, in particular welded to one another, at at least 5% of the intersections 5, in particular at at least 10% of the intersections 5.

Here too, the nonwoven overlay 7 is compressed. However, the longitudinal threads 3.1, 3.2 cannot be deflected in the transverse direction. The transverse forces are absorbed by the integral bonds at the points of intersection 5. As a result, penetration of the first fabric ply 1 and of the second fabric ply 2 is avoided or at least reduced. The void volume of the fabric plies 1, 2 is hardly reduced by penetrating threads 3, 4 of the other fabric ply 2, 1 and thus continues to be available for liquid absorption.

LIST OF REFERENCE SIGNS

1 first fabric ply
2 second fabric ply
3 longitudinal thread
3.1 longitudinal thread
3.2 longitudinal thread
4 transverse thread
5 intersection
6 absorbent thread
7 nonwoven overlay

The invention claimed is:

1. A press felt for a machine for producing a fibrous material web, comprising:

a nonwoven overlay; and a woven base structure with said nonwoven overlay fixed thereon, said woven base structure having a first woven fabric ply and a second woven fabric ply;

wherein at least said first fabric ply has longitudinal threads and transverse threads which intersect at intersections, wherein said longitudinal threads and said transverse threads of said first fabric ply are connected to one another in an integrally bonded manner at at least 5% of said intersections;

wherein said longitudinal threads and said transverse threads of said first fabric ply are welded to one another at less than 60% of said intersections; and wherein points of said intersections being integrally bonded are not situated exclusively in a seam region but are uniformly distributed over an entire area of the press felt.

2. The press felt according to claim 1, wherein said second fabric ply has longitudinal threads and transverse threads which intersect at intersections, wherein said longitudinal threads and said transverse threads of said second fabric ply are connected to one another in an integrally bonded manner.

3. The press felt according to claim 1, wherein said woven base structure has a further ply.

4. The press felt according to claim 1, wherein at least some of said longitudinal threads and/or of said transverse threads of said first fabric ply are absorbent threads which absorb laser light of a wavelength which lies in a range between 780 nm and 1100 nm entirely or to a significant extent.

5. The press felt according to claim 4, wherein at least every tenth transverse thread of said transverse threads is an absorbent thread.

6. The press felt according to claim 4, wherein at least every tenth longitudinal thread of said longitudinal threads is an absorbent thread.

7. The press felt according to claim 2, wherein for each of said intersections at which said longitudinal threads and said transverse threads are connected to one another in said integrally bonded manner in said first fabric ply and/or said second fabric ply, there is no integral bond at adjacent intersections of said intersections.

8. The press felt according to claim 1, wherein said points of said intersections being integrally bonded are not situated exclusively in a partial region of the press felt but are distributed over an entire area of the press felt.

9. The press felt according to claim 1, wherein said longitudinal threads and said transverse threads of said first fabric ply are connected to one another in said integrally bonded manner at at least 10% of said intersections.

10. The press felt according to claim 1, wherein said longitudinal threads and said transverse threads of said first fabric ply are welded to one another at less than 5% of said intersections.

11. The press felt according to claim 2, wherein said longitudinal threads and said transverse threads of said second fabric ply are welded to one another at at least 5% of said intersections.

12. The press felt according to claim 2, wherein said longitudinal threads and said transverse threads of said second fabric ply are welded to one another at at least 10% of said intersections.

13. The press felt according to claim 3, wherein said further ply is a further fabric ply.

14. The press felt according to claim 5, wherein at least every fourth transverse thread of said transverse threads is an absorbent thread.

15. The press felt according to claim 5, wherein at least every second transverse thread of said transverse threads is an absorbent thread.

16. The press felt according to claim 4, wherein at least every fourth longitudinal thread of said longitudinal threads is an absorbent thread.

17. The press felt according to claim 4, wherein at least every second longitudinal thread of said longitudinal threads is an absorbent thread.

* * * * *